United States Patent [19]

Boratto et al.

[11] Patent Number: 4,840,051

[45] Date of Patent: Jun. 20, 1989

[54] STEEL ROLLING USING OPTIMIZED ROLLING SCHEDULE

[75] Inventors: Francisco Boratto, Westmount; Stephen Yue, Montreal; John J. Jonas, Westmount, all of Canada

[73] Assignee: Ipsco Inc., Canada

[21] Appl. No.: 55,945

[22] Filed: Jun. 1, 1987

[51] Int. Cl.[4] ..... B21B 1/00

[52] U.S. Cl. ..... 72/11; 72/13; 72/229; 72/234; 72/365; 73/866; 364/472; 374/48; 374/134

[58] Field of Search ..... 73/866; 374/45-52, 374/134; 364/472; 72/199, 229, 365, 366, 234, 11, 13, 12

[56] References Cited

PUBLICATIONS

T. Tanaka, N. Tabata, T. Hatomura and C. Shiga: 'Three Stages of the Controlled Rollin Process', Microalloying '75, Washington, DC, 1975, Union Carbide, New York, 1977, pp. 107-119.

S. Benrong, Z. Peixiang and Z. Ronglin: 'A Study of Controlled Rolling Technology in the ($\gamma+\alpha$) Two--Phase Region', HSLA Steels, Metallurgy and Applications, Beijing, China, 1985, ASM International, 1986, pp. 181-188.

P. D. Hodgson, J. A. Szalla and P. J. Cambell: 'Modelling of Thermomechanical and Metallurigical Processes in Plate Rolling', 4th. International Steel Rolling Conference, Deauville, France, Jun. 1987, 1 paper C-8.

P. Choquet, A. Le Bon and Ch. Perdrix: 'Mathematical Model for Prediction of Austenite and Ferrite Microstructures in Hot Rolling Processes', Strength of Metals and Alloys (ICSMA 7), 1985, Pergamon, New York, 1985, pp. 1025-1030.

F. Boratto, S. Yue, J. J. Jonas and T. H. Lawrence: 'Production of High Strength Nb Microalloyed Steel Sheet in a Steckel Mill', 4th. International Steel Rolling Conference, Deauville, France, Jun. 1987, 2, paper F-20.

*Primary Examiner*—Robert L. Spruill
*Assistant Examiner*—Steven B. Katz
*Attorney, Agent, or Firm*—Leydig, Voit & Mayer

[57] ABSTRACT

A series of thermomechanical workings such as temperature-controlled torsional strains are applied to a specimen of steel at strain and temperature levels and interpass times selected to simulate rolling mill conditions. The measured stress values are compared with the temperatures of the steel during the working periods during which the respective values were obtained. Thermomechanical working schedules are repeated at selected varying starting and terminating temperatures thereby to obtain a series of possible rolling schedules. These simulations are selected so that a varying number of reduction passes in the sequence occur at steel temperatures below temperature $A_{r3}$. The value of a selected parameter of the worked steel, e.g. yield strength, is measured at ambient temperature. From the rolling mill analogue of possible rolling schedule simulations, an optimized rolling schedule is selected which will predictably impart to the steel a value of the selected parameter falling within a predetermined range.

14 Claims, 2 Drawing Sheets

SIMULATED ROLLING SCHEDULE, Average schedule with passes of 30%. Delay time = 30s, last pass temperature = 715°C.

SIMULATED ROLLING SCHEDULE, Average schedule with passes of 30%. Delay time = 30s, last pass temperature = 715°C.

STEEL ROLLING USING OPTIMIZED ROLLING SCHEDULE

BACKGROUND OF THE INVENTION

This invention relates to the optimized rolling of steel, particularly microalloyed steel.

In an as-hot rolled microalloyed steel, optimum strength and toughness are conferred by a fine grained polygonal ferrite structure. Additional strengthening is available via precipitation hardening and ferrite work hardening, although these are generally detrimental to the fracture properties. The development of a suitable fine grained structure by thermomechanical processing or working such as hot rolling, can be considered to occur in three or rarely four stages or regions. In the first, a fine grained structure is produced by repeated austenite recrystallization at high temperatures. This is followed, in the second, by austenite pancaking at intermediate temperatures. The third stage involves the still lower temperatures of the intercritical region, i.e. the ferrite/austenite two-phase range. Rarely, further working below the ferrite/austenite two-phase temperature range can occur. The final microstructure is dictated by the amounts of strain applied in each of these stages.

The first stage occurs at temperatures above a critical temperature $T_n$, being the temperature below which there is little or no austenite recrystallization. The second stage occurs at temperatures below temperature $T_n$ but above another critical temperature $A_{r3}$, being the upper temperature limit below which austenite is transformed into ferrite. The third stage occurs at temperatures below temperature $A_{r3}$ but above another critical temperature $A_{r1}$, being the lower temperature limit below which the austenite-to-polygonal ferrite transformation is complete. The final stage occurs below temperature $A_{r1}$ (The designations $A_{r3}$ and $A_{r1}$ are generally used to identify the upper and lower temperature limit respectively of the ferrite/austenite two-phase region, as it exists during cooling.) Since no useful improvement in steel characteristics normally occurs below temperature $A_{r1}$, steel is not ordinarily rolled below this temperature, although further such rolling would tend to further harden the steel.

Some basic principles of rolling schedule design are known. It is known, for example, that beneficial results are obtained by straining the steel to a significant extent in the intercritical region between temperatures $A_{r3}$ and $A_{r1}$: Matrosov et al., "Influence of Incremental Deformation in Gamma Plus Alpha and Alpha Regions on Mechanical Properties of 0962 Steel" (1979) 11 Izvestiya VUZ Chernaya Metallurgiya 115. Tanaka et al. have recognized that the three useful stages of deformation occurring respectively above temperature $T_n$, between temperatures $T_n$ and $A_{r3}$, and between temperatures $A_{r3}$ and $A_{r1}$ can be analyzed to facilitate design of a useful rolling schedule: Tanaka et al., "Three Stages of the Controlled Rolling Process" Microallying '75, Union Carbide, Washington, D.C., 1975, p. 107.

In order to design a rolling schedule to produce desired mechanical properties in the steel, the temperature ranges or regions over which the three normally useful stages of deformation occur must be reasonably accurately known. However, the critical temperatures $T_n$, $A_{r3}$ and $A_{r1}$ are not known a priori from the steel composition—rather, they are themselves also dependent on the rolling schedule. The rolling schedule details must therefore be known to some extent before the temperature limits of the three regions can be defined.

Heretofore, steel rolling schedules have been determined on an empirical basis typically involving a good deal of trial and error. It has not been possible to derive predictable quantitative relationships between desired steel properties and rolling mill operating parameters. In many cases the result has been that an appreciable proportion of steel production has not met specifications, especially where specifications are high and a fairly narrow "window" of acceptable mill operating conditions sufficient to enable specifications to be met exists.

SUMMARY OF THE INVENTION

The invention has application to the rolling of steel, especially microalloyed steel, in a rolling mill whose operating conditions are known or measurable. The steel is of a known alloy composition. The number of sequential reduction passes (at steadily declining steel temperatures between rolls separated by sequentially diminishing gaps) is preselected.

The invention is the process of rolling the steel in accordance with an optimized rolling schedule.

The object of the invention is to make possible the selection of an optimum rolling schedule based upon a quantitative analysis of available data, in other words to lend a scientifically-based predictability to the rolling schedule selection, which heretofore has been made on a trial-and-error basis.

The inventors have found that in order to lend reliable predictabilibty to the rolling schedule selection process, it is not necessary to derive equations or relationships based on any determination of temperature $T_n$ or temperature $A_{r1}$. It is sufficient if temperature $A_{r3}$ is known or estimated reasonably precisely.

There are accordingly two types of situation addressed by the present invention. In the first type of situation, the temperature $A_{r3}$ is not known, and must be ascertained. In the second type of situation, the temperature $A_{r3}$ is reasonably precisely known or can be reasonably precisely estimated.

If the temperature $A_{r3}$ is not precisely enough known, then the following procedure according to the invention is carried out:

(a) A series of thermomechanical workings such as temperature-controlled torsional strains are applied to a single specimen of the steel at selected strain values during selected working periods and at selected steel temperatures. The working periods are separated by selected rest time (simulated interpass) intervals. The foregoing selections are chosen to simulate the sequence of reduction passes of the steel under the conditions encountered in the rolling mill. (The term "pass" is used to refer to the passage of the steel between a pair of rolls to reduce its thickness, whether in reciprocating fashion in a Steckel mill, or in unidirectional fashion in a mill having several pairs of reduction rolls aligned in series.)

(b) The measured stress values obtained from the series of workings are compared with the inverse of the temperatures of the steel prevailing during the working periods during which the respective values were obtained. Preferably the average stress values are compared with the inverse of the temperatures. Changes in the character of the functional relationship between stress and temperature values enable a determination of the upper limit $A_{r3}$ of the austenite-ferrite transformation temperature range during working of the steel while cooling.

(c) Step (a) is preferably repeated for a series of specimens of the steel at selected varying starting and terminating temperatures thereby to obtain a series of possible rolling schedule simulations. These simulations are selected so that a varying number of reduction passes in the sequence occur at steel temperatures below said upper limit $A_{r3}$. For example, if the total number of passes is to be 11, the selected simulations might be four in number, with respectively 1, 2, 3 and 4 passes occurring below temperature $A_{r3}$.

(d) The value of a selected steel property, e.g. yield strength, is measured at ambient temperature (e.g. room temperature) for specimens of the steel each of which has undergone a discrete one of the rolling schedule simulations.

(e) From the rolling mill analogue of possible rolling schedule simulations made pursuant to step (c), at least one predetermined rolling schedule is selected which will predictably impart to the steel a value of the selected property (e.g. yield strength) falling within a predetermined range.

Steel of the selected alloy composition is then rolled according to the selected rolling schedule.

The rolling schedule derived according to the foregoing procedure may be further refined or optimized by applying linear regression analysis to rolling mill data. In some cases, there will be a substantial compilation of rolling mill data available over a range of operating parameters, and temperature $A_{r3}$ for the apparent optimum range of rolling schedules to achieve steel having an acceptable value or range of acceptable values of a particular property, may be reasonably precisely known. In the latter type of situation, the torsional stress simulation of the rolling schedule may be omitted, and in accordance with another aspect of the invention, the rolling schedule may be further refined or optimized by applying linear regression analysis.

In order to refine the austenite grain size before the austenite-to-ferrite transformation, deformation must be applied in Region 1, which has a lower temperature limit of $T_n$ below which little or no austenite recrystallization occurs. Region 2, which is the pancaking range, is delimited by temperatures $T_n$ and $A_{r3}$. For some mills, it may be decided that the reductions in Region 1 should be carried out in a slabbing mill and those in Region 2 by the rougher and in the first passes of the finishing mill. Reductions in the final finishing stage should ordinarily occur below temperature $A_{r3}$, in Region 3.

The foregoing procedure can be advantageously employed in the rolling of microalloyed steel in any steel rolling mill, but is especially usefully employed where the mill is a Steckel mill or comparable mill where only a single pair of rolls is used and the steel passes first in one direction, then the other, through the rolls, the roll gap being reduced after each pass. Time lags and steel cooling tend to be greater in such mills than in mills permitting the steel to move in one direction through a series of roll pairs, and consequently more attention typically has to be paid to control of the rolling process in a Steckel mill.

If the comparison of stress values with temperature is done by means of visual inspection of a plotted graph, it will be found advantageous in step (b) to plot average stress values against the inverse of steel temperature.

Multiple linear regression analysis may advantageously be applied to rolling mill data obtained from the measurement of selected parameters including at least steel temperature at the final reduction pass, time elapsed and total strain between the reaching of temperature Ar3 and the final pass, and carbon content of the steel. These data enable one to derive a correlation between the foregoing variables and yield strength, tensile strength and elongation of the steel respectively, according to formulae of the following forms:

$$Y=a_1+b_1E-c_1K-d_1t+e_1C$$

$$Z=a_2+b_2E-c_2K-d_2t+e_2C$$

$$L=-a_3-b_3E+c_3K-d_3t-e_3C$$

where $a_1$, $a_2$, $a_3$, $b_1$, $b_2$, $b_3$, $c_1$, $c_2$, $c_3$, $d_1$, $d_2$, $d_3$, $e_1$, $e_2$ and $e_3$ are constants which are usually positive and which have been empirically determined from the rolling mill data, E is the total strain occurring at temperatures below said upper limit, K is the temperature of the steel during the final pass, t is the elapsed time from the reaching of said upper limit until the last pass, C is the carbon content of the steel, Y is the yield strength of the steel, Z is the tensile strength of the steel, and L is the elongation of the steel. Note that the selection of the constants will depend upon the scales chosen.

It can be seen that the correlation between a desired steel property such as yield strength and significant rolling mill parameters takes the general form $$\text{Property}=a+bE+cK+dt+eC,$$

where a, b, c, d and e are positive or negative constants, and all variables are as defined above.

Note that the foregoing equations can be modified to select alternative parameters that vary linearly with those selected. For example, instead of K, the final pass temperature, one could have selected $\Delta T$, the difference between temperature $A_{r3}$ and the final pass temperature. The applicable constants of proportionality would have to be changed accordingly.

DETAILED DESCRIPTION

Figure 1:
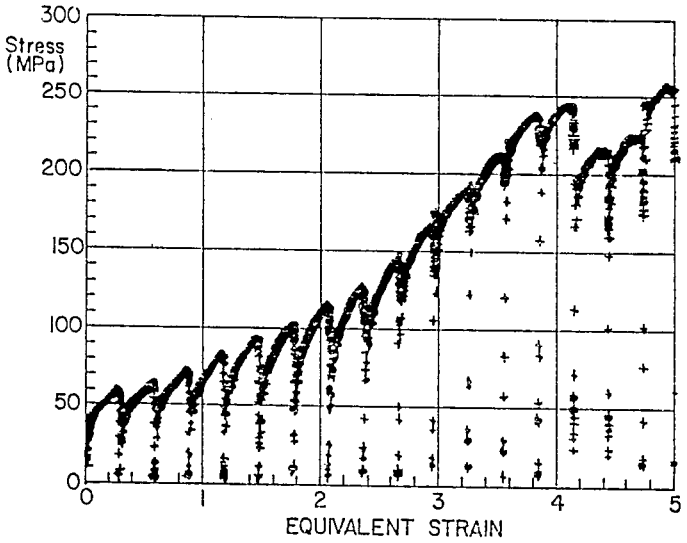
FIG. 1 is a graph showing a series of stress-strain results from a simulated roll schedule obtained by applying a series of torsion thermomechanical workings to a specimen of the steel to be rolled.

Because it is an object according to the first aspect of the invention to select the number of roll passes that occur below temperature $A_{r3}$, being the upper limit of the austenite-ferrite phase transformation during cooling, the first problem is to determine especially critical temperature $A_{r3}$ and, as a matter of lesser importance, critical temperatures $T_n$ and $A_{r1}$, for the steel to be rolled. These temperatures, for a given alloy, are not accurately known a priori, because they are dependent upon the thermomechanical working history of the steel. Accordingly, if temperature $A_{r3}$ is not reasonably precisely known, it is necessary to run the steel through a series of thermomechanical workings at declining temperatures to determine at least temperature $A_{r3}$ and preferably all of these critical temperatures. For example, temperature $T_n$ could be determined by using a cam plastometeror other compression device, and temperature $A_{r3}$ by means of a deformation dilatometer.

One must put the steel through an approximate rolling schedule, or simulated rolling schedule, so that one can determine the critical temperatures with accuracy. The eventual objective is to devise a fully optimized rolling schedule on the basis of accurate critical temperatures, and especially temperature $A_{r3}$.

Many of the rolling schedule parameters are determined by the mill geometry and operating characteristics; others by the required amount of reduction of the steel. And a number of conventional rolling schedule design principles are well known and continue to apply. For example, per cent strain is often chosen to be highest during initial roughing passes and lowest during later finishing passes, especially the final pass. Given the known parameters and applying conventional design criteria, a preliminary rolling schedule design can be devised which will suffice to establish a number of the final design parameters. The principal variable whose value is to be resolved by application of the design procedure of the present invention is steel temperature at various passes, and especially the last few passes.

Fortunately it is not necessary to run the steel through a rolling mill to determine the critical temperatures and those rolling schedule parameters remaining to be determined. It is already previously known that a small piece of the steel taken from a slab prior to rolling can be thermomechanically worked in a torsion testing machine under a working schedule that simulates the actual rolling schedule which the slab of steel would undergo in the rolling mill. (See Migaud, "Simulation by Hot Torsion Testing of Hot Strip Mill Rolling", International Conference on Hot Working and Forming Processes, Sheffield, 1979, The Metals Society, London, 1980, pp. 67–76.) The amount of strain applied to the steel, the time during which it is applied, the prevailing steel temperature to be maintained during each pass, and the expected time interval between successive passes, can all be controlled in the torsion test so that the series of torsion strains (at the temperatures prevailing throughout the torsion test) imparts to the steel characteristics that can be related to those which the steel would acquire in a rolling mill, under the same set of prevailing temperatures, according to known principles of correlation.

A stress/strain curve can then be plotted for the series of passes or simulated passes. A representative stress/strain curve is shown in FIG. 1. In FIG. 1, strain is the abscissa and stress the ordinate. The successive peaks in the curve obtained represent the completion of a pass (or in the case of the simulation, the completion of a single torsional strain cycle). The curve of FIG. 1 is representative of the kind of curve that is obtained by repeated thermomechanical working of a specimen of steel under cooling conditions; in other words as one progresses from left to right in the graph of FIG. 1, one progresses from the hottest steel temperature to the coldest steel temperature during the rolling schedule (or, more precisely, the torsional analogue of a rolling schedule).

Figure 2:
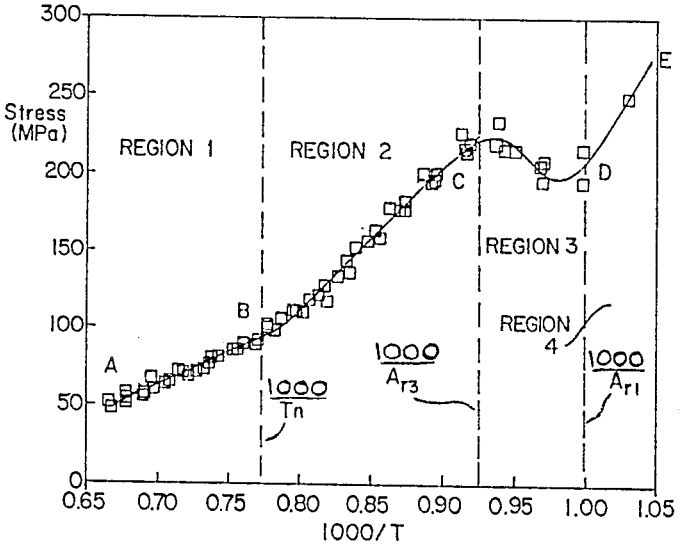
FIG. 2 is a graph plotting the mean stress values of the type to which FIG. 1 relates against the reciprocal of steel temperatures prevailing during the series of simulated passes of the steel.

The average stress or peak stress imparted to the steel specimen during each torsional thermomechanical working cycle can then be plotted against the inverse of temperature of the steel during each thermomechanical working period of the simulated rolling schedule. Such a plot is depicted in FIG. 2 in which the inverse of temperature (in degrees Kelvin) is the abscissa and average stress the ordinate. The small squares represent points of measurement within a reasonable margin of error. This enables a curve to be drawn approximating the behaviour of stress relative to temperature. FIG. 2 shows representative measurement points obtained over a multiplicity of trials, which explains the crowding of the points in some parts of the graph; however, it has been found that a single series of torsion test measurements suffices to determine temperatures $T_n$, $A_{r3}$ and $A_{r1}$ reasonably precisely.

It can be seen that the curve of FIG. 2 can be separated into four discrete components. Portion AB is a linear portion of the curve at the most gentle slope. This defines region 1 and point B defines temperature $T_n$ being the temperature below which little or no recrystallization of the austenite occurs. There follows a portion BC of the curve of higher slope; the curve flattens out at point C and at temperatures lower than the temperature at point C, stress tends to fall off relative to the reciprocal of temperature. The portion BC of the curve defines region 2 of the rolling schedule; the upper bound of region 2 is at temperature $T_n$ and the lower bound at temperature $A_{r3}$ being the temperature below which austenite to ferrite transformation occurs during the cooling of the steel.

Below temperature $A_{r3}$, as noted, the slope of the curve of FIG. 2 becomes negative but eventually a trough is reached and a positive slope returns. Point D represents the approximate point at which the curve resumes its steady upwards slope. Point D reflects a temperature $A_{r1}$ being the lower limit at which austenite is transformed into polygonal ferrite during the cooling of the steel. Thus, point D permits a further division of regions, the curve portion CD defining region 3 between temperatures $A_{r3}$ and $A_{r1}$ and the region DE (E representing somewhat arbitrarily the end of the curve illustrated) defining region 4 below temperature $A_{r1}$. Normally steel is not rolled at temperatures much below temperature $A_{r1}$ since further rolling below that temperature does not ordinarily contribute to desirable characteristics of the finished product and produces high rolling loads.

The temperatures $T_n$, $A_{r3}$ and $A_{r1}$ are readily visually identified by an inspection of the curve of FIG. 2. Instead of a manual plot and visual analysis, any desired computer analysis could be substituted to identify the critical changeover points in the curve which enable the determination quite accurately of the three critical temperatures $T_n$, $A_{r3}$ and $A_{r1}$ for the particular alloy of steel under consideration and the rolling schedule simulated.

Figure 3:
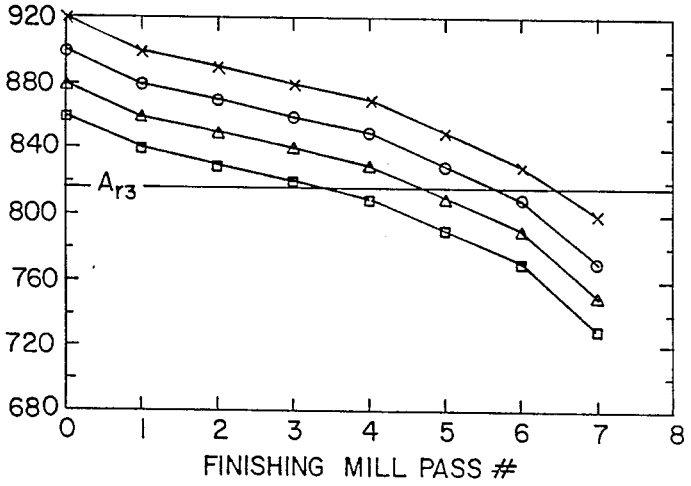
FIG. 3 is a graph plotting temperature against finishing pass number, for a series of four different rolling schedules, each schedule selected to provide a different number of passes below critical temperature $A_{r3}$.

Having ascertained the critical temperatures $T_n$, $A_{r3}$ and $A_{r1}$ and particularly temperature $A_{r3}$ which is most significant to design of an optimized rolling schedule, a number of different rolling schedules are devised which are essentially similar to one another so far as relative strain per pass, pass duration, and interval between passes are concerned but which differ in that the starting temperature and terminating temperature of the steel are varied. The variation is selected over the multiplicity of schedules so that the number of finishing passes which occur below temperature $A_{r3}$ is varied. FIG. 3 shows graphically the result obtained, plotting temperature against the pass number for a representative Steckel mill operation according to four discrete roll schedules. In the first schedule marked by a series of crosses or X's, only the final pass (number 7 in the arbitrary roll schedule sequence followed) has been made below temperature $A_{r3}$. In a second roll schedule sequence marked by circles, it can be seen that both the sixth (penultimate) and seventh (final) passes have been made below temperature $A_{r3}$. In the third roll schedule marked by triangles, three passes namely the fifth, sixth and seventh occur below temperature $A_{r3}$. Finally, in the fourth schedule marked by squares, four passes are made below temperature $A_{r3}$.

Again, an actual rolling sequence is not necessary in order to obtain the curves of FIG. 3; a torsional test simulation can be arranged which will, according to known principles of conversion, closely approximate an actual rolling mill schedule for a particular mill and a particular steel alloy under consideration.

Certain desired characteristics such as yield strength, tensile strength or elongation can be measured for steel subjected to the four different roll schedules whose temperature versus mill pass characteristics are illustrated in FIG. 3. Let us suppose that yield strength (at ambient temperature) is the parameter of greatest interest to the roll schedule designer. In that case, the actual yield strength of a specimen of the steel subjected to each of the four rolling schedules of FIG. 3 would be compared with the torsion yield strength observed in specimens subjected to a simulated rolling schedule, as discussed above, to obtain four discrete values for each of the four roll schedules devised. The results are plotted in FIG. 4, which shows the actual mill yield strength and torsion yield strength values obtained respectively for the four roll schedules schematically identified in FIG. 3, (all measurements taken at ambient temperature) again the cross, circle, triangle and square representing the results obtained for actual mill yield strength and torsion yield strength for the resulting steel product obtained after following respectively the four schedules to which FIG. 3 is directed. These four values can be seen to be linearly related, and a straight line has been drawn through the points.

Let us suppose that the rolling mill schedule designer wishes to have a steel with an actual yield strength of at least 700 MPa. Looking at FIG. 4, it can be seen that only the roll schedule in which four passes are completed below temperature $A_{r3}$ suffices to produce a steel having a yield strength above 700 MPa. Therefore the roll schedule designer knows that to obtain this desired yield strength, he must choose the fourth roll schedule represented in FIG. 3, namely the one marked by squares, in preference to the ones marked by crosses, circles and triangles. The design engineer could then if he wishes repeat the process illustrated with reference to FIG. 3 and FIG. 4 but bringing the repeated roll schedules all closer to the roll schedule marked by squares in FIG. 3, so as to further refine his choice of possible roll schedules.

(During roughing, as is already known in the art, it may also be considered desirable to avoid rolling close to temperature $T_n$ in order to avoid the partial recrystallization of austenite, which can lead to non-uniform final ferrite microstructures.)

If an actual yield strength of only 600 MPa were desired, then the roll schedule marked by circles would be expected to be optimum of the four illustrated in FIG. 3, since that choice results in an actual yield strength of above 600 MPa. The roll schedule marked by circles would be expected to be superior to that marked by triangles or squares because the latter two would tend to produce somewhat less ductile or formable steel than the roll schedule marked by circles. If however a harder less ductile steel were desired, the design engineer could select from the roll schedule marked by triangles or the roll schedule marked by squares and still be confident of obtaining steel having an actual yield strength above 600 MPa.

Figure 4:
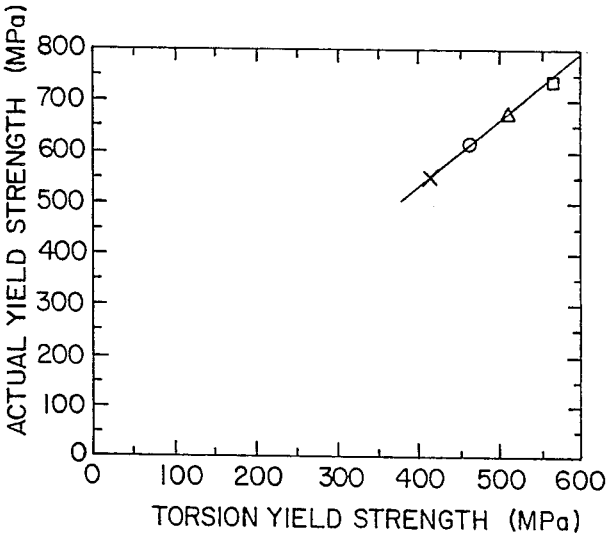
FIG. 4 is a graph plotting actual mill yield strength against torsion yield strength for the four steel products obtained from the four rolling schedules depicted graphically in FIG. 3.

Suppose that the roll schedule designers wished to have a yield strength below 500 MPa. In that case, none of the points in FIG. 4 obtained from the four selected roll schedules to which FIG. 3 is directed, would suffice. The designer would know enough to make further tests of roll schedules in which no pass occurred below temperature $A_{r3}$ or might well in the circumstances elect to try a different alloy, because the alloy giving the results illustrated in FIG. 4 is a relatively high quality alloy giving relatively high yield strengths under quite acceptable rolling schedule conditions.

Desirably, rolling mill data are correlated with torsion test data to ensure that the optimized rolling schedule predicted by the analysis lives up to its expectations, so far as the end qualities of the steel are concerned. As a second aspect of the invention, an appropriate quantity of rolling mill data obtained over a period of time for various batches of steel of a given alloy rolled pursuant to desirable rolling schedules can be utilized for a multiple linear regression analysis to derive quantitative relationships between desirable steel characteristics and parameters governing preferred rolling mill schedules. The inventors have found that steel yield strength, tensile strength and elongation can be correlated with steel temperature at the final roll pass, the elapsed time between the reaching of temperature $A_{r3}$ and the final pass, the total strain occurring between the reaching of temperature $A_{r3}$ and the final pass, and the carbon content of the steel, pursuant to the equations previously mentioned, viz.

$$Y=a_1+b_1E-c_1K-d_1t+e_1C$$

$$Z=a_2+b_2E-C_2K-d_2t+e_2C$$

$$L=-a_3-b_3E+C_3K-d_3t-e_3C$$

where $a_1$, $a_2$, $a_3$, $b_1$, $b_2$, $b_3$, $C_1$, $C_2$, $C_3$, $d_1$, $d_2$, $d_3$, $e_1$, $e_2$ and $e_3$ are constants (usually positive) empirically determined from the rolling mill data, E is the total strain occurring at temperatures below said upper limit, K is the temperature of the steel during the final pass, t is the elapsed time for the reaching of said upper limit until the last pass, C is the carbon content (by weight per cent) of the steel, Y is the yield strength of the steel, Z is the tensile strength of the steel, and L is the elongation of the steel.

Application of these equations to desired yield strength, desired tensile strength or desired elongation can be utilized to refine further the preferred rolling mill schedule.

EXAMPLE

The present invention was utilized in the rolling of a microalloyed steel to produce 586 MPa (85 ksi) sheet in the Steckel mill of Ipsco Inc. in Regina, Canada. The temperature boundaries of the four regions illustrated in FIG. 2 were established by torsion testing of small specimens of the alloy selected. Schedule design was facilitated because a number of coils of the microalloyed steel had already been produced in the Ipsco mill. Thus, the required correlation between deformation strain and microstructure was generated using a regression analysis relating the final mechanical properties to the actual rolling parameters without recourse to further testing.

The torsion tests described here were carried out on a computer controlled servo-hydraulic machine of known design. An argon protection chamber was added to the equipment to prevent excessive oxidation of the samples. A Leeds-Northrup 1300® temperature programmer in series with a Leeds-Northrup Electromax-V® controller was also added so that heating and cooling could be carried out at specified rates.

The main purpose of each simulation was to apply a deformation-time-temperature sequence as close as possible to the one followed in the Ipsco mill. The computer applies the required strain per pass, unloads the sample for a given delay time between passes, and continues the deformation sequence as programmed. The conversion of torque and angle of rotation into equivalent stress and equivalent straih for each pass is also performed by the computer and stored on magnetic disc for future calculations.

The alloy selected had the following composition (Table 1):

TABLE 1

Composition limits for Ipsco's low carbon microalloyed steel.

| Element: | Minimum %: | Maximum %: |
|---|---|---|
| C | 0.09 | 0.11 |
| Mn | 0.40 | 0.50 |
| S | — | 0.006 |
| P | 0.073 | 0.085 |
| Si | 0.30 | 0.40 |
| Cu | 0.25 | 0.40 |
| Ni | 0.35 | 0.45 |
| Cr | 0.45 | 0.55 |
| V | 0.05 | 0.07 |
| Cb | 0.03 | 0.05 |
| Mo | 0.25 | 0.35 |
| Sn | — | 0.05 |
| Al | 0.03 | 0.05 |
| N | 0.009 | 0.015 |
| Ti | 0.07 | 0.10 |

As described above, in conventional controlled rolling, microstructural development occurs in three ranges of temperature: (i) the region in which the recrystallization of austenite takes place; (ii) the no-recrystallization zone; and (iii) the austenite plus ferrite two-phase region. These ranges are defined by the no-recrystallization temperature, $T_n$ and the temperatures at the start $A_{r3}$ and end ($A_{r1}$) of the austenite to ferrite transformation. Region 1 is situated above $T_{nr}$, region 2 between $T_n$ and $A_{r3}$, and region 3 below $A_{r3}$ but above $A_{r1}$ (see FIG. 2). Rolling in Region 4 (below temperature $A_{r1}$) is not recommended. The first step in the rolling schedule design was, therefore, to determine these critical temperatures.

Torsion testing was used to determine the critical temperatures. The method used arbitrarily involved a series of 17 torsion deformations, each of 30% strain, with a delay of 30 seconds between each deformation. The 30 second delay is approximately representative of the average delay between passes in the Ipsco Steckel mill. The first strain was executed at 1200° C. The specimen was then subjected to a cooling rate close to 1° C./s for the subsequent strains. The final strain was delivered at 705° C. This torsion test sequence is, in effect, an approximation of the Ipsco schedule. The first seven strains of the torsion test are a simplification of the initial slabbing passes in the mill, but the final 10 deformations closely simulate the 3 roughing and 7 finishing mill passes of the Ipsco process. Because Ipsco's strip mill is a Steckel mill, there is a relatively long interval between successive passes in the finishing mill.

The resulting stress-strain curves for all the passes in the torsion test enabled the generation of a graph of the type shown in FIG. 1. Basically, the strength of the steel increases continuously with decreasing temperature until a significant amount of austenite has transformed to ferrite. After this point, i.e. at pass 13 in the schedule followed, the strength decreases because ferrite has a lower flow stress than austenite. The subsequent increase in flow strength, beginning at pass 16, is due to a combination of ferrite work hardening and temperature decrease. In the austenite region, in which passes 1 to 12 occur, a transition in the flow strength versus temperature behaviour occurs at pass 8. Passes 1 to 8 illustrate a lower rate of flow strength increase with decreasing temperature than do passes 9 to 12. This is consistent with a transition from recrystallization to non-recrystallization behaviour. Thus, all the critical temperatures can be obtained from this single multiple-step torsion test.

While a manual plotting of stress vs. reciprocal of temperature (FIG. 2) enables a reasonably close visual determination of the critical temperatures of interest, a more precise analysis of the test results was made using regression techniques using the Gauss-Newton BARD algorithm, and performed on plots of the mean stress values versus 1000/T (T=absolute temperature) as shown in FIG. 2. The continuous line through the data points in FIG. 2 corresponds to a non-linear optimization of the following functions:

$$S=(A+B\cdot 1000/T),\ \text{for } T\geqq T_n \quad (1)$$

and $$S=(A'+B'\cdot 1000/T)(1-V)+(C+D\cdot 1000/T)V,\ \text{for } T<T_n \quad (2)$$

where S is the mean stress and V is the volume fraction of ferrite at temperature T. Therefore, $$T_n=1000(B-B')(A'-A) \quad (3)$$

Also, empirically, $$V=H(1000/T)^J/[1+H(1000/T)^J \quad (4)$$

The temperature at which V=0.05 can be taken as the temperature $A_{r3}$.

Similarly, the value of T at which V=0.95 corresponds to temperature $A_{r1}$, viz. the temperature at the end of the intercritical region. Thus $$A_{r3} = 1000(19.00H)^{1/J} \quad (5)$$

and $$A_{r1} = 1000\left(\frac{H}{19.00}\right)^{1/J} \quad (6)$$

In equations (3), (5) and (6) all temperatures are expressed in degrees Kelvin. The values for the constants A, B, A', B', G, D, H and J calculated from the non-linear optimization, are shown in Table 2:

TABLE 2

| Constants for Equations 1 to 4. These values were obtained by non-linear optimization of the data points in FIG. 2. | | | | | | | |
|---|---|---|---|---|---|---|---|
| A | B | A' | B' | G | D | H | J |
| −181.24 | 342.34 | −625.65 | 919.47 | −1472.1 | 1680.5 | 26.458 | 73.195 |

This leads to the following temperatures:

$T_n = 1026°$ C.

$A_{r3} = 816°$ C.

$A_{r1} = 732°$ C.

While some slight variation in these temperatures may be expected if the rolling schedule ultimately used departs from the initial experimental simulated schedule, the variation has been found in practice not to be significant, and the inventive method may be used as long as the initial simulated rolling schedule is a reasonable approximation of the final optimized schedule.

Once these temperatures were known, a regression analysis was carried out to relate the observed mechanical properties to the mill process variables. This included an analysis of the amount of deformation in each of the three regions. It was found that significant correlations existed only with the total strain E below the temperature $A_{r3}$, the total elapsed time t spent in rolling (or equivalent torsion deformation) below the temperature $A_{r3}$, and the temperature K of the last pass in the finishing mill. An additional regression analysis between the mechanical properties and the alloy composition revealed a strong dependence on carbon content only. It is possible that for other alloy compositions, the equations derived and set forth below would have to include a term dependent upon the quantity present of alloying elements other than carbon. This could readily be determined empirically. The complete results of these regression analyses are described in the following equations:

$$Y = 1161 + .593E - 1.221K - .111t + 3853C \quad (7)$$

$$Z = 1146 + .474E - .939K - .081t + 2572C \quad (8)$$

$$L = -36 - .0013E + .103K - .0037t - 147C \quad (9)$$

where all terms are as previously defined. Here E is given in percentage, K in °C. and t in seconds.

It should be emphasized that these equations apply only to steels with chemical compositions that fall within the limits shown in Table 1. The following process parameter restrictions shown in Table 3 also apply:

TABLE 3

| Process Variable | Critical Process Parameters Minimum | Maximum |
|---|---|---|
| Finish temp (°C.) | 710 | 815 |
| Total time below $A_{r3}$(S) | 120 | 666 |
| Total strain below $A_{r3}$ (%) | 17 | 211 |
| Total strain in region 2 (%) | 70 | 200 |
| Total strain in region 1 (%) | 200 | 270 |

Within these limitations, the above equations (7), (8), (9) yield results which are accurate to within the following root mean square deviations (RMSD):

| Mechanical property | RMSD |
|---|---|
| Yield strength | 23 MPa |
| Tensile strength | 19 MPa |
| Elongation | 2.2% |

In the Ipsco mill, the following mill constraints apply:

Roughing entrance thickness = 68.50 mm

Last roughing pass thickness ≧ 20.OO mm

Finishing entry temperature ≧ 880° C.

Strain at last finishing pass ≦ 18%

The rolling schedule was selected to provide heavy deformations initially and relatively light reductions at the end, for maximum dimensional control rather than on the basis of classical controlled rolling principles. The problem was then to produce desired mechanical properties (the principal one of which was a yield strength of greater than 586 MPa, and a second objective of yield to ultimate tensile strength ratio less than 0.93) employing a schedule of reductions based on the above constraints. The reductions define the time taken to complete a pass via the following empirical correlation between the minimum time per pass, tm (in seconds), and the exit sheet thickness, h (in mm), for the roll velocities in current use at Ipsco Inc.

$$t_m = 24.8 + 243.4/h$$

The pass temperatures are determined by the times per pass and the strip mill entry temperature. Since the times per pass had already been selected, the only significant factor that could be varied was the finishing mill entry temperature. This temperature was then chosen to match the minimum mechanical property requirements by using the correlations given in Equations 7 to 9. The resulting schedule is shown in Table 4 and is within the mill operation constraints; the predicted yield strength of the strip under these conditions is greater than the minimum requirement of 586 MPa 85 ksi). The predicted yield to ultimate tensile strength ratio is 0.90, which is less than the target maximum of 0.93.

TABLE 4

| Optimized finishing schedule: Pass No. | Exit (mm) | Strain (%) | T (°C.) | Time (seconds) |
|---|---|---|---|---|
| 1R | 43.62 | 52 | 970 | 30 |

TABLE 4-continued

| Pass No. | Exit (mm) | Strain (%) | T (°C.) | Time (seconds) |
|---|---|---|---|---|
| | Optimized finishing schedule: | | | |
| 2R | 28.94 | 47 | 945 | 32 |
| 3R | 20.00 | 43 | 910 | 36 |
| 1F | 16.57 | 22 | 860 | 39 |
| 2F | 13.80 | 21 | 850 | 42 |
| 3F | 11.56 | 20 | 840 | 45 |
| 4F | 9.73 | 20 | 830 | 49 |
| 5F | 8.24 | 19 | 810 | 54 |
| 6F | 7.01 | 19 | 790 | 60 |
| 7F | 6.00 | 18 | 750 | coil |

Note that the requirement that the yield strength to ultimate tensile strength ratio be less than 0.93 sets a lower temperature (and a maximum strain) limit to working in the inter-critical region: For example, if the last pass temperature is below 730° C and the total strain below temperature $A_{r3}$ is greater than 80%, the 0.93 ratio limit will be surpassed. Thus a useful operational "window" is defined for this alloy which sets limits for the last pass temperature and for the total strain below temperature $A_{r3}$.

In order to test the above rolling schedule, a torsion simulation was performed and the resulting microstructure was compared to those of specimens with known yield strengths. No significant difference between the grain sizes of these structures was observed.

This schedule was then put into practice in the Ipsco mill. The results followed the predictions from the analyses and the torsion simulation. In a series of test runs, the only failures to meet target specifications noted were related to alloys with carbon contents below the minimum shown in Table 1.

Regression analysis revealed that the yield strength depends essentially on the accumulated deformation below the temperature $A_{r3}$. The implication is that the amount of hot reduction performed above temperature $A_{r3}$, i.e. in the recrystallization and no-recrystallization regions, does not vary sufficiently to affect the mechanical properties significantly. Apparently, the total strain in each of these two regions, which is relatively high, is sufficient to produce the grain refinement required in the particular alloy used. Thus, slight changes in the strain in each region are unlikely appreciably to alter the ferrite grain size or to alter the values of the critical temperatures. This is borne out by the fact that little difference was observed between the microstructures of specimens above and below the minimum strength requirement of 586 MPa. By contrast, the work hardening capacity of the ferrite is far from saturation after the final pass. As a result, the yield strength was found to be sensitive to variations in the total strain below temperature $A_{r3}$. There are two ways in which the latter can be varied: (i) by altering the reduction in the last two or three passes; (ii) by changing the rolling temperatures, such that the number of passes that occur below temperature $A_{r3}$ is altered. The latter is a much more potent technique for optimizing rolling schedules for the Ipsco mill. For example, referring to Table 4, an increase in the finishing mill entry temperature of only 20° C. decreases the strain available for work hardening the ferrite by nearly 40%. Thus, the rolling temperature during finishing is critical in the Ipsco process. In practice, this means that accurate control of the finishing mill entry temperature, as well as of the descaling practice in the Steckel mill, the strip speed and, to a lesser extent, the coiler furnace temperature, are critical, if the desired properties are to be consistently attained.

What is claimed is:

1. In the rolling of steel of a known alloy composition in a rolling mill whose operating conditions are known or measurable by a selected number of sequential reduction passes at steadily declining steel temperatures between rolls separated by sequentially diminishing gaps, the improvement comprising rolling the steel in accordance with a rolling schedule determined in accordance with the following procedure:

(a) applying to a specimen of the steel a series of thermomechanical workings at selected strain levels imparted during selected steel temperatures, and separated by selected rest time intervals, all selected to simulate the sequence of reduction passes of the steel under the conditions encountered in the rolling mill;

(b) comparing stress values obtained from the series of workings with the inverse of the temperatures of the steel at which the respective values were obtained thereby to determine the upper limit of the austenite-ferrite cooling transformation temperature range;

(c) repeating step (a) for a series of specimens of the steel at selected varying starting and terminating temperatures thereby to obtain a series of possible rolling schedule simulations having a varying number of reduction passes in the sequence thereof occurring at steel temperatures below said upper limit;

(d) measuring the value of a selected property at ambient temperature of specimens of the steel each of which has undergone a discrete one of the rolling schedule simulations; and (e) selecting from the rolling mill analogue of possible rolling schedule simulations at least one predetermined rolling schedule which will predictably impart to the steel a value of said selected property falling within a predetermined range.

2. The improvement of claim 1, wherein the steel is a microalloyed steel.

3. The improvement of claim 2, wherein the selected property is yield strength.

4. The improvement of claim 3, wherein in step (b) the stress values are average stress values.

5. The improvement of claim 3, wherein the workings comprise successive applications to the specimens of torsional strain at controlled temperatures.

6. The improvement of claim 3, additionally comprising applying multiple linear regression analysis to rolling mill data obtained from the measurement of selected parameters including at least steel temperature at the final reduction pass, time elapsed and total strain between the reaching of the said upper limit and the final pass, carbon content of the steel, thereby to derive a linear relationship therebetween and said selected property of the steel.

7. The improvement of claim 6, wherein the linear relationship is expressible in a formula of the following form:

$$\text{Selected property} = a + bE + cK + dt + eC,$$

where a, b, c, d and e are positive or negative constants empirically determined from the rolling mill data, E is the total strain occurring at temperatures below said upper limit, K is the temperature of the steel during the final pass, t is the elapsed time from the reaching of said upper limit until the last pass, C is the carbon content of the steel.

8. The improvement of claim 3, additionally comprising applying multiple linear regression analysis to rolling mill data obtained from the measurement of selected parameters including at least steel temperature at the final reduction pass, time elapsed and total strain between the reaching of the said upper limit and the final pass, carbon content of the steel, thereby to derive linear relationships therebetween and yield strength, tensile strength and elongation of the steel respectively expressible in formulae of the following forms:

$$Y = a1 + b1E - c1K - d1t + e1C$$
$$Z = a2 + b2E - c2K - d2t + e2C$$
$$L = -a3 - b3E + c3K - d3t - e3C$$

where al, a2, a3, bl, b2, b3, cl, c2, c3, dl, d2, d3, el, e2 and e3 are constants empirically determined from the rolling mill data, E is the total strain occurring at temperatures below said upper limit, K is the temperature of the steel during the final pass, t is the elapsed time for the reaching of said upper limit until the last pass, C is the carbon content of the steel, Y is the yield strength of the steel, Z is the tensile strength of the steel, and L is the elongation of the steel.

9. The improvement of claim 3, wherein the mill is a Steckel mill.

10. In the rolling of microalloyed steel of a known alloy composition in a rolling mill whose operating conditions are known or measurable by a selected number of sequential reduction passes at steadily declining steel temperatures between rolls separated by sequentially diminishing gaps, and wherein the upper limit of the austensite-ferrite cooling transformation temperature range is sufficiently accurately known or estimated, the improvement comprising rolling the steel in accordance with a rolling schedule determined in accordance with the following procedure:

(a) applying multiple linear regression analysis to rolling mill data obtained from the measurement of selected parameters including at least steel temperature at the final reduction pass, time elapsed and total strain between the reaching of the said upper limit and the final pass, carbon content of the steel, thereby to derive a linear relationship therebetween and a selected property of the steel; and (b) selecting a set of values for controllable parameters in said linear relationship to derive at least one predetermined rolling schedule which will predictably impart to the steel a value of said selected property falling within a predetermined range.

11. The improvement of claim 10, wherein the selected property is yield strength.

12. The improvement of claim 10, wherein the linear relationship is expressible in a formula of the following form:

$$\text{Selected property} = a + bE + cK + dt + eC,$$

where a, b, c, d and e are positive or negative constants empirically determined from the rolling mill data, E is the total strain occurring at temperatures below said upper limit, K is the temperature of the steel during the final pass, t is the elapsed time from the reaching of said upper limit until the last pass, C is the carbon content of the steel.

13. The improvement of claim 10, additionally comprising applying multiple linear regression analysis to rolling mill data obtained from the measurement of selected parameters including at least steel temperature at the final reduction pass, time elapsed and total strain between the reaching of the said upper limit and the final pass, carbon content of the steel, thereby to derive a linear relationship therebetween and yield strength, tensile strength and elongation of the steel respectively expressible in formulae of the following forms:

$$Y = a_1 + b_1E - c_1K - d_1t + e_1C$$

$$Z = a_2 + b_2E - c_2K - d_2t + e_2C$$

$$L = -a_3 - b_3E + c_3K - d_3t - e_3C$$

where $a_1$, $a_2$, $a_3$, $b_1$, $b_2$, $b_3$, $c_1$, $c_2$, $c_3$, $d_1$, $d_2$, $d_3$, $e_1$, $e_2$ and $e_3$ are constants empirically determined from the rolling mill data, E is the total strain occurring at temperatures below said upper limit, K is the temperature of the steel during the final pass, t is the elapsed time for the reaching of said upper limit until the last pass, C is the carbon content of the steel, Y is the yield strength of the steel, Z is the tensile strength of the steel, and L is the elongation of the steel.

14. The improvement of claim 10, wherein the mill is a Steckel mill.

* * * * *

UNITED STATES PATENT AND TRADEMARK OFFICE

CERTIFICATE OF CORRECTION

PATENT NO. : 4,840,051

DATED : 20 June, 1989

INVENTOR(S) : Boratto, Yue and Jonas

It is certified that error appears in the above-identified patent and that said Letters Patent is hereby corrected as shown below:

On the cover page, at line 1 of the Abstract, prior to "A series ...", insert --This invention is the process of rolling microalloyed steel in accordance with a rolling schedule determined as follows:--.

On the cover page, at line 3 of the Abstract, after "men of" insert --the--.

On the cover page, at line 7 of the Abstract, after "obtained." insert --Changes in the character of the functional relationship between stress and temperature values enable a determination of the upper limit $A_{r3}$ of the austenite-ferrite transformation temperature range.--

On the cover page, at line 19 of the Abstract, after "range." insert --As another aspect of the invention, linear regression analysis is applied to empirically obtained rolling mill data to derive one or more linear relationships between a selected property (e.g. yield strength) of the steel and rolling It is certified that error appears in the above-identified patent and that said Letters Patent is hereby corrected as shown below:

mill parameters including steel temperature at the final reduction pass, time elapsed and total strain between the reaching of the said upper limit and the final pass, and carbon content of the steel, thereby to permit selection of an optimum rolling schedule suitable to obtain a preselected value of the selected property of the steel.--.

In column 1, at line 38, following "$A_{r1}$" (first appearance) insert --.--.

In column 4, at line 27, the sentence beginning "Note ..." should begin a new line.

In column 5, at line 12, delete "plastometeror" and insert therefor --plastometer or--.

In column 6, at line 35, delete "austenite to ferrite" and insert therefor --austenite-to-ferrite--.

In column 9, at line 32, delete "straih" and insert therefor --strain--.

UNITED STATES PATENT AND TRADEMARK OFFICE

CERTIFICATE OF CORRECTION

PATENT NO. : 4,840,051

DATED : 20 June, 1989

INVENTOR(S) : Boratto, Yue and Jonas

It is certified that error appears in the above-identified patent and that said Letters Patent is hereby corrected as shown below:

In column 9, at line 63, delete "$T_{nr}$" and insert therefor --$T_n$--.

In column 10, at line 63, following "... $[1+H(1000/T)^{J}$" insert --]--.

In column 12, at line 61, delete "85 ksi)" and insert therefor --(85 ksi)--.

In column 15, at line 14, delete "Z".

In column 15, at line 15, insert --Z-- prior to "= ...".

In column 15, at line 15, delete "L".

In column 15, at line 16, insert --L-- prior to "= ...".

Signed and Sealed this

Twenty-eighth Day of August, 1990

*Attest:*

*Attesting Officer*

HARRY F. MANBECK, JR.

*Commissioner of Patents and Trademarks*